United States Patent [19]

Lundblad

[11] 4,128,236

[45] Dec. 5, 1978

[54] SHEET FEEDING APPARATUS

[75] Inventor: Leif Lundblad, Huddinge, Sweden

[73] Assignee: Inter Innovation AB, Stockholm, Sweden

[21] Appl. No.: 824,601

[22] Filed: Aug. 15, 1977

Related U.S. Application Data

[63] Continuation of Ser. No. 673,347, Apr. 2, 1976, abandoned.

[30] Foreign Application Priority Data

Apr. 7, 1975 [SE] Sweden ..... 7503941

[51] Int. Cl.[2] ..... B65H 3/04; B65H 3/06; B65H 3/38

[52] U.S. Cl. ..... 271/10; 271/35; 271/110; 271/118

[58] Field of Search ..... 271/110, 111, 118, 117, 271/35, 34, 10, 265, 38

[56] References Cited

U.S. PATENT DOCUMENTS

| | | | |
|---|---|---|---|
| 690,702 | 1/1902 | Cross | 271/111 |
| 790,681 | 5/1905 | Dexter | 271/111 |
| 2,849,916 | 9/1958 | Nolan | 271/265 X |
| 3,260,520 | 7/1966 | Sugden | 271/35 X |
| 3,288,461 | 11/1966 | Smith | 271/110 X |
| 3,514,098 | 5/1970 | Ostwald | 271/110 |
| 3,575,410 | 4/1971 | Suzuki | 271/111 |
| 3,740,031 | 6/1973 | Scully | 271/35 |
| 3,990,694 | 11/1976 | Mason et al. | 271/118 X |

*Primary Examiner*—Bruce H. Stoner, Jr.
*Attorney, Agent, or Firm*—Charles E. Brown

[57] ABSTRACT

Apparatus for removing sheets one at a time from a face of a stack of sheets wherein a flow-line is established between a primary feed roller or belt and sheet seizing means downstream thereof defining a nip, a lever system downstream of the nip for creating relative separation between the face and the feed roller or belt, the lever system including first and second levers each having first and second portions and first and second fixed pivots, the first portion of the first lever being disposed downstream of the nip and located normally to obstruct the flow-line but being movable from the flow-line by the passage of a sheet therealong, the first portion of the second lever being effective for effecting relative separation between the face and the feed roller or belt, and the second portion of the first lever controlling pivoting of the second lever about the second fixed pivot in direct mechanical repsonse to the movement of the first lever first portion by a sheet moving downstream of the nip.

9 Claims, 18 Drawing Figures

SHEET FEEDING APPARATUS

This is a continuation of application Ser. No. 673,347 filed Apr. 2, 1976, now abandoned.

This invention relates to an improved sheet feeding apparatus of the kind in which sheets are moved individually from a stack by means of a feeding device, and then fed along a flow-line.

The apparatus to which this invention relates is useful for feeding sheets of a variety of kinds but has particular application to the feeding of paper sheets such as, for example, banknotes.

The apparatus herein described and claimed is characterised by its possession of novel and improved means for producing desired gaps between adjacent sheets as they pass along the flow-line.

According to this invention, apparatus for removing sheets one at a time from a face of a stack of sheets and feeding the sheets so removed sequentially along a flow-line includes a primary feed means adapted to engage said face and to feed a sheet from the stack in a direction substantially parallel to said face and mechanical means having a first component disposed in the flow-line and adapted, by and during the passage of a sheet thereacross, to be moved from a position in which it obstructs the flow-line to a second position in which it does not obstruct the flow-line, and a second component adapted upon such movement of the first component to render said primary feed means ineffective.

Preferably, the primary feed/means is rendered ineffective by relative separation between it and the face.

Preferably the mechanical means comprises a simple or a compound lever system so arranged that a part thereof obstructs the flowline and is adapted to be moved from the flow-line on the passage of a sheet; another part of the lever system being arranged during the passage of a sheet either to move the stack or the feeder. Preferably the feeder is a friction feeder, for example, a driven friction roller or belt.

The mechanical means may be actuated solely by the passage of sheets or by powered means which, in turn, is controlled by the passage of sheets.

Preferably an apparatus "start-stop" control comprises means adapted to disengage the feed roller and the stack independently of the passage of a sheet along the flow-line. Conveniently said control means comprises a solenoid connected to the lever system and upon energisation to effect the said disengagement.

BRIEF DESCRIPTION OF FIGURES

Non-limiting examples of feeding apparatus according to the invention will now be described with reference to the accompanying drawings of which.

It should be noted that frame and other structural components which are not critical to the understanding of the invention have been omitted or drawn in chain-dotted outlines.

Figure 9:
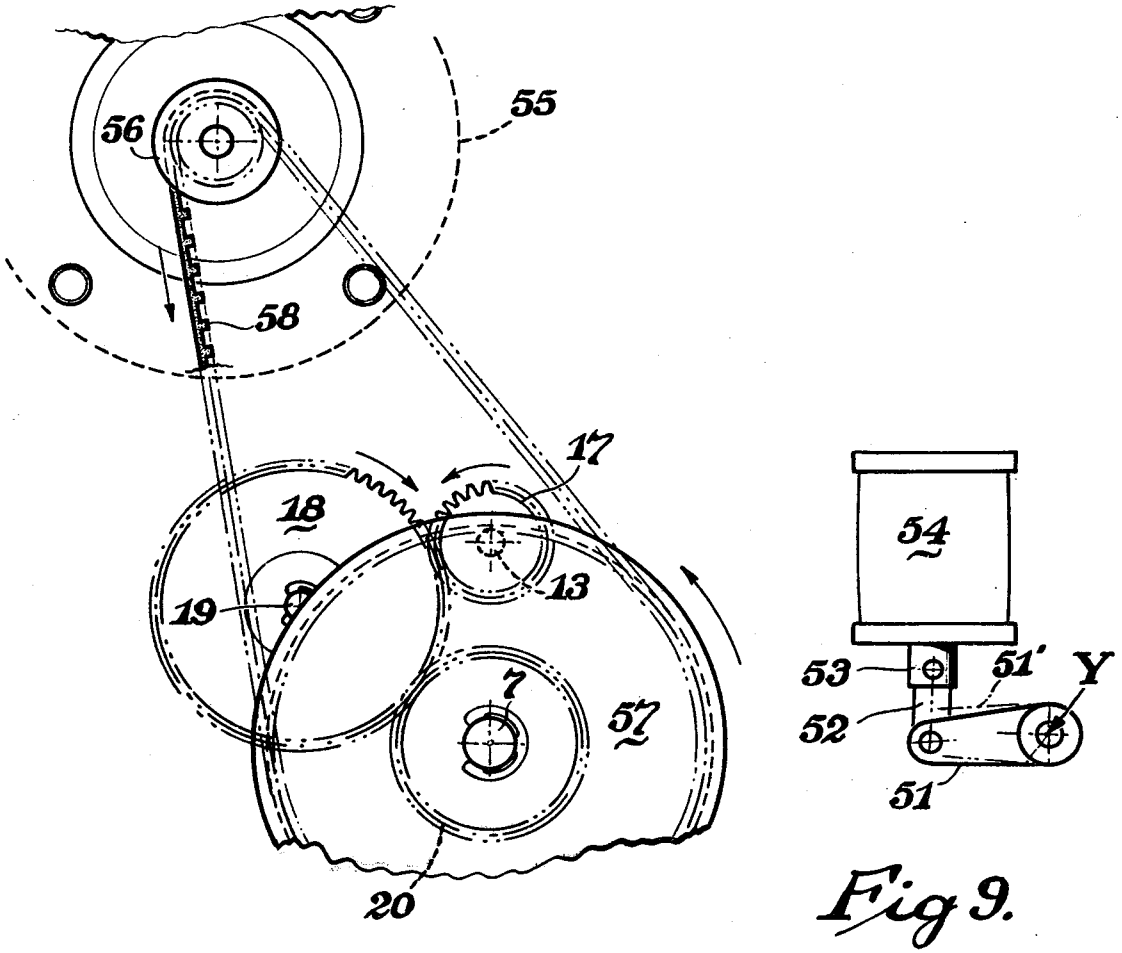
FIG. 9 is a side elevation of a driving means for the apparatus.

The apparatus essentially includes a pair of vertical main frames (not shown) disposed in spaced parallel relationship between which all of the mechanism, with the exception of that part shown in FIG. 9, is disposed. Various transverse bridging members (not shown) are provided between the frames to effect rigidity and maintain alignment of the assembly. It will be appreciated that whilst the following description relates to an apparatus having a particular orientation it may be modified to operate differently, for example, the said frames may be disposed horizontally and the associated mechanism therefore turned through 90°.

BROAD DESCRIPTION OF THE APPARATUS

The general concept of the apparatus will best be appreciated by a brief reference to FIGS. 10–13 in which symbol 1 represents a horizontal support surface adapted to support a stack of banknotes, N. A vertical transverse plate member 2 is provided to locate the leading edge of the stack, and a weighted pressure pad 3 serves to bias the stack against the support surface 1. The surface 1 is cut-away at a central portion to provide working clearance for various feeding and control components which essentially include a primary friction feed roller 4 of soft rubber material which is freely mounted upon a fixed-axis transverse shaft 5. The periphery of the roller 4 protrudes through the said cut-away portion of support surface 1 and co-acts with the underside of the stack in such a manner that anti-clockwise rotation of the same engages frictionally with and propels the lowermost banknote N1 into the collective nip of a feeding and restraining means; this nip is described in detail below but comprises firstly a secondary friction feed roller 6 and a nonrotary spring biased pressure member 25 which together form a nip for seizing a banknote and feeding it away from the stack and secondly, as the said restraining means, a pair of friction rollers 14 adapted to act against the direction of feed and to hold back other banknotes from entering the feeding nip. Thereafter, the banknotes is turned through 180° around the periphery of a secondary friction feed roller 6 (which comprises one component of the feeding means) and is finally delivered along a path disposed below and parallel to the stack (see N1 in FIG. 13). The roller 6 is also of soft rubber material and is fixedly mounted upon a driven shaft 7 which in turn drives the primary feed roller 4 by means of a belt 8. It will be observed from FIGS. 1 and 2 that the rollers 4 and 6 are deeply grooved to receive the belt 8 thereby to ensure that it does not contact the banknotes.

Figures 7, 8:
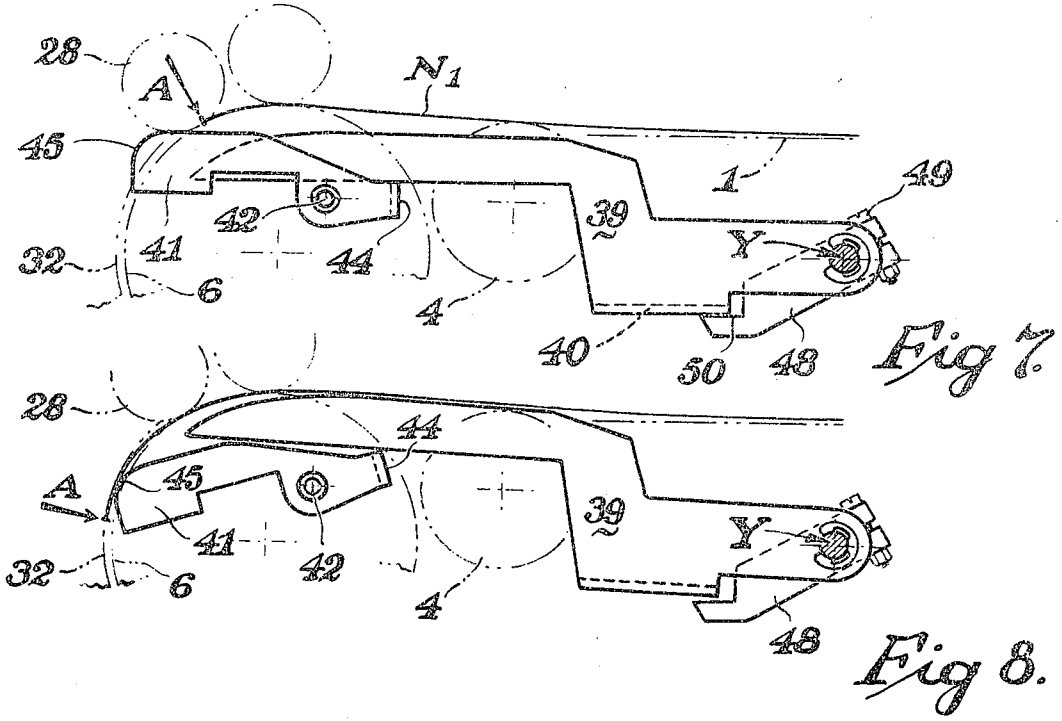
FIGS. 7 and 8 are side elevations of parts of the mechanism contained in FIGS. 1 and 2 shown in two different operative positions.

A reciprocal lever means is provided below the stack to lift its front end clear of the periphery of the primary feed roller 4, thereby to interrupt or inhibit feeding; this lever means, which, is described below with specific reference to FIGS. 7 and 8, is powered by the passage of banknotes propelled around the periphery of the secondary feed roller 6 thereby to provide intermittent feeding and hence to create substantially equal spaces between adjacent banknotes fed along a flowline. In addition, the said lever means is also adapted to provide an overall operation control for the apparatus, solenoid means being provided to cause the lever to lift the stack clear of rotating feed roller 6 when it is desired to arrest feeding. This aspect is also described in detail below.

DETAILED DESCRIPTION OF THE APPARATUS

Figure 1:
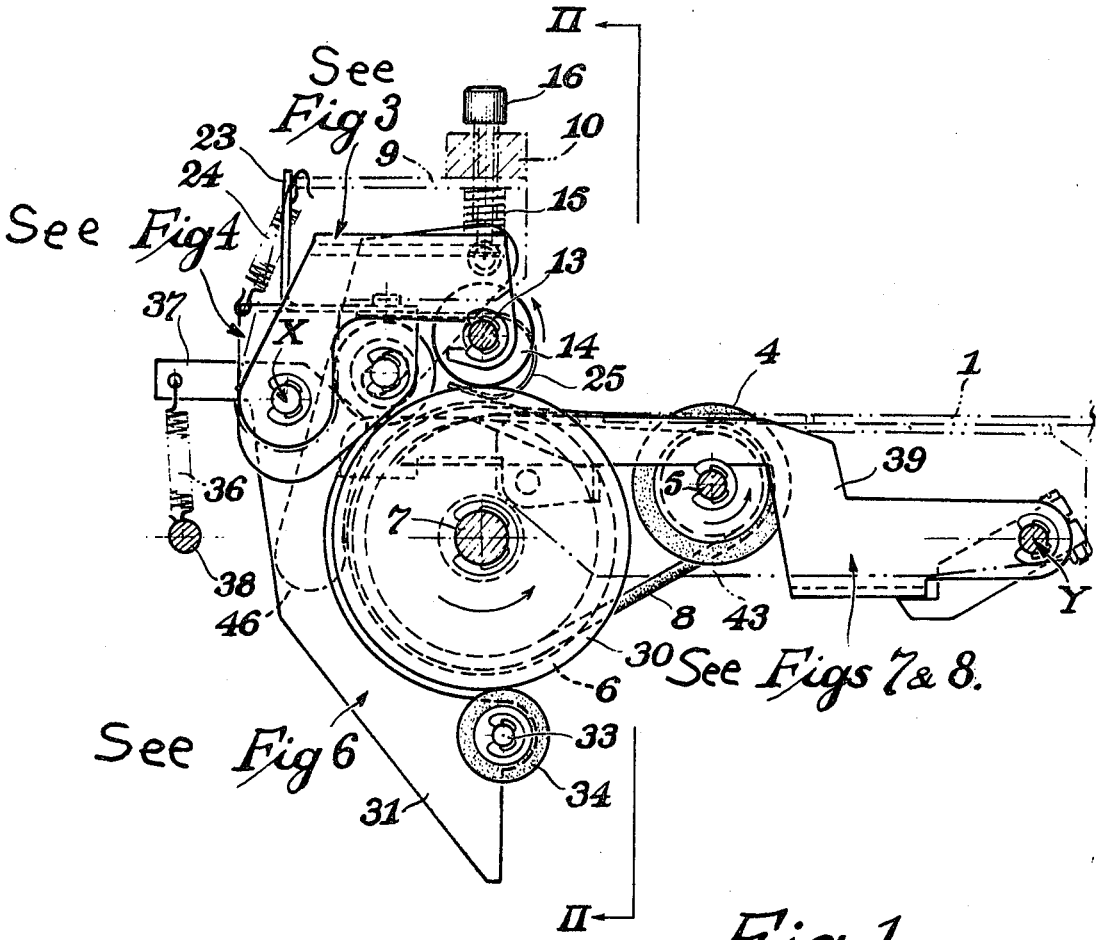
FIG. 1 is a side elevation of a mechanism adapted to feed banknotes sequentially from a stack.
Figure 2:
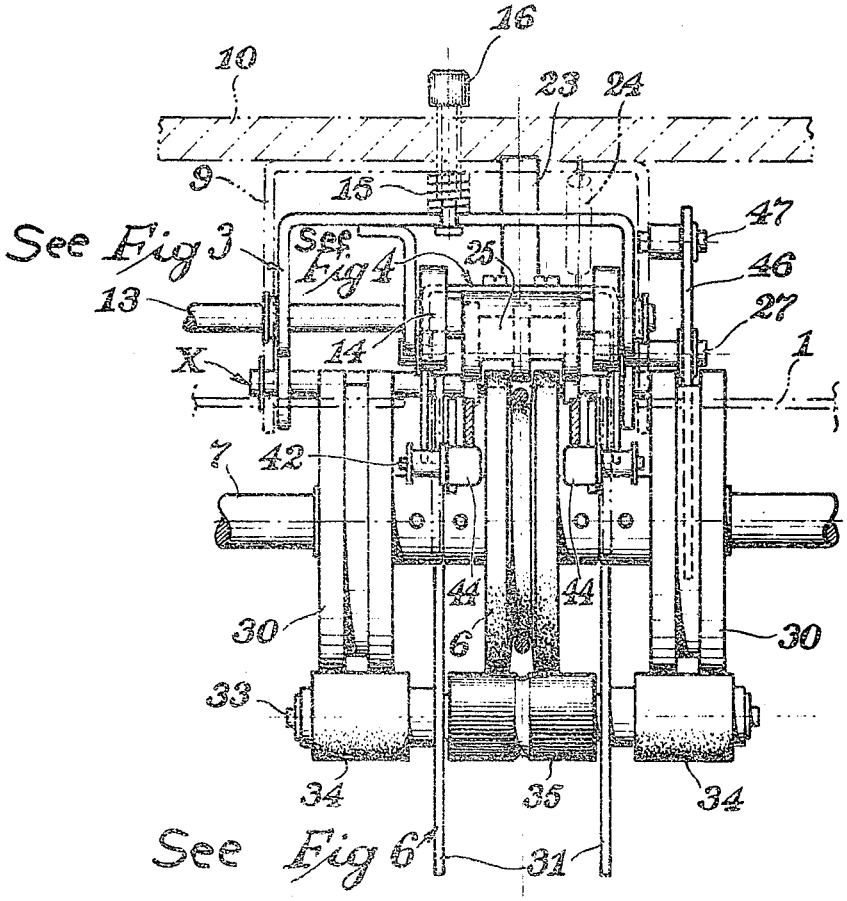
FIG. 2 is an end view along the vertical plane II—II of FIG. 1.

In order to facilitate a detailed description of the apparatus and to eliminate the need for a complexity of reference numerals, cross-references to other figures have been provided in the general arrangement views, (FIGS. 1 and 2). Each of these other figures relates to a particular sub-assembly, the overall relationship of which will be apparent by the location of their respective mounting shafts which are indicated in FIGS. 1 and 2 by symbols X and Y.

Figure 3:
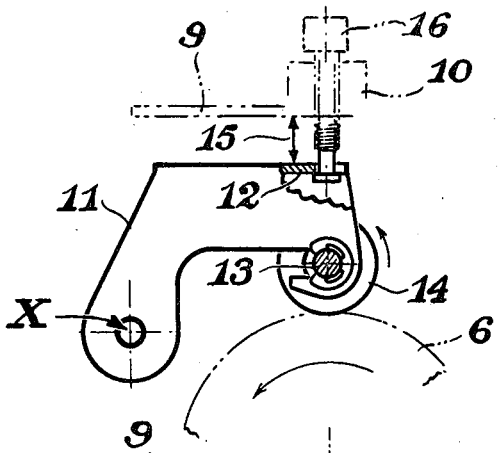
FIGS. 3, 4 and 6 are side elevations of sub-assemblies contained in the mechanism shown in FIGS. 1 and 2.
Figure 4:
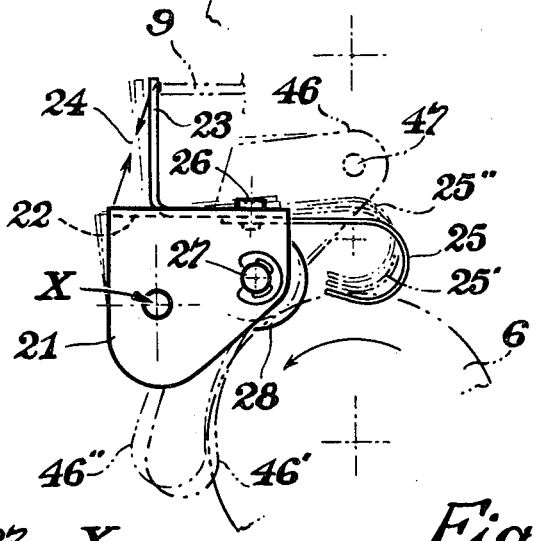
Figure 6:
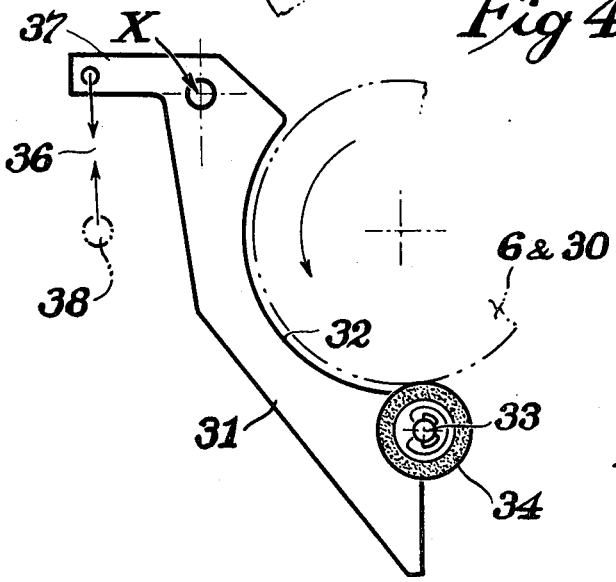

Shaft X comprises a fixed-axis transverse shaft, the opposite ends of which are supported in the lower extremities of the limbs of an inverted "U" bracket member 9 which is attached to the underside of a transverse bar 10 rigidly mounted to the main frames. Disposed between the said limbs are three "nested" pivotal lever assemblies which are illustrated in FIGS. 3, 4, and 6 respectively.

The outer assembly (FIG. 3), comprises an inverted "U" shaped lever having vertical side limbs 11 and an intermediate horizontal portion 12. The side limbs form bearings for a driven horizontal shaft 13 upon which is fixedly mounted a pair of friction rollers 14 mounted in spaced relationship and driven in an anti-clockwise direction. The particular slot-entry bearing arrangement shown in FIG. 3 is provided solely to facilitate assembly of the apparatus. The lever is spring-biased in a clockwise direction by means of a compression spring (shown by symbol 15 in FIGS. 1 and 2, and diagrammatically by a double-ended arrow in FIG. 3) and is restrained from clockwise rotation by the enlarged end of an adjustment screw 16. As will be seen from FIG. 3 a slot is provided to receive the neck part of the screw adjacent the said enlarged end. This screw thereby serves as an adjustable stop, which in turn positions the peripheries of the friction rollers 14 relatively to the periphery of the previously mentioned secondary feed roller 6; it will be observed from FIG. 2 that the rollers 6 and 14 are transversely spaced across the apparatus and accordingly no positive nip is formed between the said peripheries. The purpose of the adjustment screw 16 is referred to in detail in the description "Operation of the Apparatus" below.

The shaft 13 is driven in an anti-clockwise direction by means of a gear pinion 17 disposed externally of the frame; see FIG. 9. Referring briefly to FIG. 9, it will be seen that the pinion 17 is driven from an idler gear wheel 18, freely mounted upon a stub shaft 19, and in turn driven by a pinion 20 which is fixedly mounted to the shaft 7 and associated with the secondary feed roller 6. It will be appreciated that rotation of the lever assembly shown in FIG. 3 about its pivot axis X alters the mesh of the pinion 17 and the idler gear 18. However, this movement is substantially tangential to the gear 18 and consequently the depth of mesh is virtually unaffected. A clearance hole, not shown, is formed in the frame to provide adequate clearance for the shaft 13.

Figure 5:
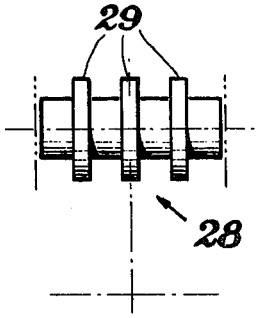
FIG. 5 is an end view of a roller component contained in FIG. 4.

The intermediate lever assembly mounted upon the shaft X will now be described with reference to FIGS. 4 and 5. This assembly is also of inverted "U" formation and includes vertical side limbs 21, bridged by an upper horizontal portion 22. The side limbs are drilled to accommodate the shaft X and the upper portion 22 is provided with a vertical tongue 23 which, in conjunction with the extremity of the bracket member 9, serves as a stop means to prevent rotation of the lever assembly in a clockwise direction. The lever is biased in a clockwise direction by means of a tension spring (shown by symbol 24 in FIGS. 1 and 2, and diagrammatically in FIG. 4 by arrows). The non-rotary pressure member 25 comprises a three-prong fork and is releasably attached to the underside of the upper portion 22 by means of two screws one of which is shown by symbol 26. The fork member is adapted to form a "mesh-nip" with the secondary feed roller 6, i.e. without making physical contact therewith. In FIG. 2, it will be seen that the central prong is capable of entering freely within the groove of the roller 6 and the side prongs are capable of clearing its opposite side faces.

The side limbs 21 of the lever are drilled to accept the opposite ends of a transverse shaft 27 upon which is freely mounted a grooved pressure roller 28. The roller 28, which is best seen in FIG. 5, is deeply grooved to define three longitudinally-spaced circumferential ridges 29 which intermesh, but without physical contact, with the secondary feed roller 6 in a manner similar to that of the fork member 25 which is described above.

From FIG. 4, it will be apparent that when the leading edge of a banknote is fed between the fork member 25 and the secondary feed roller 6 the former will be lifted and hence the assembly will be turned in an anti-clockwise direction (see chain-dotted outline 25'). Further feeding of the banknote will bring the said leading edge into effective "mesh-nip" between the grooved pressure roller 28 and the feed roller 6 with the result that the roller 28 is raised and the assembly is turned still further in an anti-clockwise direction thereby to lift the fork member 25 clear of the surface of the banknote (see chain-dotted outline 25'').

Reference is now made to two further fixedly mounted rollers which are provided on the driven shaft 7. In FIG. 2, it will be seen that a grooved auxiliary feed roller 30 is provided in spaced relationship on each side of the secondary feed roller 6. The rollers 30 comprise a hard plastics material and serve to engage and propel the banknotes outwardly of the central "mesh nip" described above. Additionally, the rollers 30 serve to support the banknotes near their side edge and hence enhance the effectiveness of the reverse-direction friction rollers 14.

Reference is now made to FIG. 6, which illustrates the third lever assembly on the shaft X. This assembly comprises a pair of transversely spaced depending levers 31 freely mounted upon the shaft X inwardly of the assembly described in FIG. 4. Each lever includes an arcuate surface 32 which serves to guide the leading end of a banknote around the peripheries of the rollers 30 and 6, and a lower bearing means for supporting a transverse shaft 33 upon which is freely mounted three nip rollers. From FIG. 2 it will be seen that the levers 31 are disposed intermediately between the rollers 30, 6 and 30, and that the said nip rollers comprise three distinct rollers 34, 35 and 34 respectively. The outer rollers 34 are made from a soft rubber material and the central roller 35 comprises a hard plastics material and is provided with an axially serrated periphery. Each lever is biased in an anti-clockwise direction by means of a tension spring 36 which connects between an arm 37 integrally formed with a lever 31 and a transverse rod 38 fixedly mounted to the frames.

The above mentioned reciprocal lever means provided to lift the stack clear of the primary feed roller is now described with reference to FIGS. 7 and 8. This lever means comprises two distinct components viz: (a) a first lever having a pair of parallel side plates 39 joined together by a bridge piece 40 and freely mounted upon a transverse shaft Y journalled in the frames, and (b) a pair of independent levers 41 freely mounted upon aligned axes 42 which are journalled in a fixed sub-frame assembly, generally indicated by the chain-dotted outline 43 in FIG. 1. The undersides of the side plates 39 bear upon a flanged extremity 44 of each of the independent levers 41 thereby to establish a mechanical interconnection between the lever components (a) and (b). Rotation of the lever side plates 39 in a clockwise direction will cause their upper edges to contact the underside of the stack in the vicinity of the primary feed roller 4 and thereafter to lift the stack clear of the said feed roller. The levers 41 are provided with rounded ends 45 which protrude into the flowline of the banknotes (i.e. into the spaces defined between the arcuate guide surfaces 32 of FIG. 6 and the peripheries of the rollers 6 and 30). It thus follows that a banknote propelled along the flowline will contact the rounded ends 45, to rotate the levers in an anti-clockwise direction about the axes 42 and the flanged extremities 44 will lift the lever side plates 39 thereby to arrest feeding by the primary feed roller 4 (see FIG. 8). It further follows that when a banknote has passed beyond the rounded ends 45 the lever system will revert to the condition shown in FIG. 7 with the result that the following banknote will be fed from the underside of the stack by the primary feed roller 4.

From the above description it is apparent that predetermined gaps are created between adjacent banknotes fed along the flowline by the lever mechanism shown in FIGS. 7 and 8. However, in the described embodiment of the invention an over-riding gap control means is provided to make and break the "mesh-nip" between the fork member 25 and the secondary feed roller 6 in accordance with the passage of banknotes fed further along the flowline. By this means the restoration of the said "mesh-nip" (and hence the effective feeding of a banknote therethrough) is delayed by a lever system described as follows. A lever 46 is freely mounted upon a pivot 47 fixedly attached to the bracket member 9 (see FIGS. 1 and 2). The end of this lever is adapted to trail within the grooved periphery of the right-hand grooved feed roller 30, and accordingly is deflected from the groove by the passage of a banknote. The two positions are illustrated by chain-dotted outlines 46' and 46" respectively in FIG. 4. Intermediately along lever 46 is provided a slotted aperture (not shown), which is adapted to receive the end extremity of the shaft 27 (see FIG. 2). The lever 46, when deflected by the passage of a banknote serves to retain the lever assembly of FIG. 4 in an anti-clockwise position inspite of the fact that the trailing end of a banknote has passed beyond the grooved pressure roller 28. Consequently the said lever assembly will not return by action of the spring 24, and the fork member 25 will not reform a "mesh-nip" with the feed roller 6 until the trailing end of the banknote has passed beyond the lever 46.

As mentioned under "Broad Description of the Apparatus", the reciprocal lever arrangement described above with reference to FIGS. 7 and 8, also serves as a control means for stopping and starting the feeding of banknotes from the apparatus. Disposed between the lever side plates 39, an arm 48 is fixedly mounted to the shaft Y by a clamping means 49. The arm 48 is provided with a notched extremity 50 adapted to contact and raise the underside of the bridge piece 40 associated with the side plates 39. The latter are freely mounted upon shaft Y and, it thus follows that clockwise rotation of shaft Y will raise the stack above the primary feed roller 4 thereby to arrest feeding. Rotation of shaft Y is effected by means of a solenoid mechanism disposed externally of the main frame and shown in FIG. 9. Symbol 51 comprises a crank arm fixedly mounted to the end of the shaft Y, 52 is a connecting link, and 53 is a sliding armature of a solenoid coil 54, which when energised turns the arm 51 to position 51', thereby arresting feeding of banknotes.

The driving means for the apparatus comprises an electric motor 55 attached to the main frame. Drive to the shaft 7 is effected by means of notched pulleys 56 and 57 via an associated belt indicated by symbol 58.

OPERATION OF THE APPARATUS

The operation of the apparatus will now be described with additional reference to FIGS. 10–13. For reasons of clarity only essential numerals have been included in these drawings.

Figure 10:
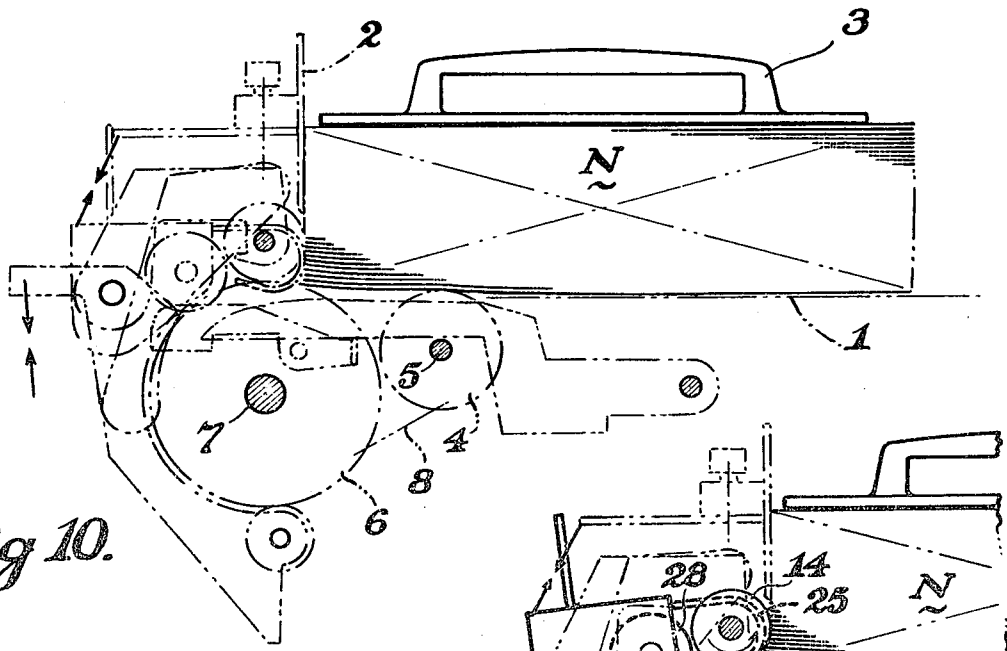
FIGS. 10–13 are diagrammatic side elevations, drawn to a reduced scale, of the apparatus in four sequential stages of operation.

FIG. 10 depicts the apparatus in a dormant or OFF condition from which it will be seen that a stack of banknotes N is disposed in contact with the periphery of the primary feed roller 4.

Figure 11:
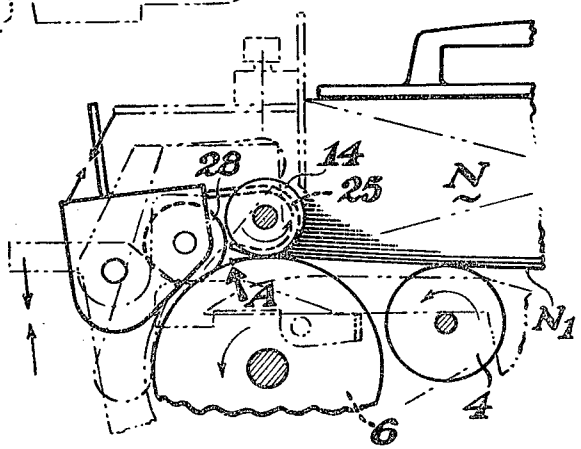
Figure 12:
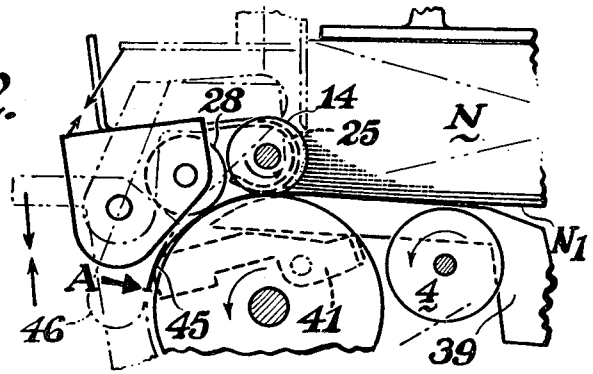

Energisation of the driving motor rotates the roller system in the direction of three curved arrows (see FIG. 11). The lower note N1 of the stack N is propelled in a leftward direction by the primary feed roller 4 and upon contacting the secondary feed roller 6 the leading end of the banknote lifts the spring-loaded fork member 25 and a first "mesh-nip" created therebetween drives it through the said nip. The reverse-direction friction rollers 14 restrain the lower front of the stack from leftward movement. In this figure the position of the leading end of the banknote N1 is indicated by arrow A.

Further movement of the banknote engages and lifts the grooved pressure roller 28 and also raises the fork member 25 from the surface of the banknote. Thereafter the banknote N1 is propelled in a positive manner by "mesh-nip" of the secondary feed roller 6 and the grooved pressure roller 28; and the breakage of the above mentioned first "mesh-nip" effectively prevents the feeding of any other banknote. Movement of any such other banknote towards the broken "mesh-nip" is, in any event, inhibited by the frictional forces exerted by the reverse-direction rollers, the said force being greater than the interleaf frictional forces between the sheet being fed and an adjacent sheet. Upon establishing contact between the leading end A of the banknote N1 and the rounded ends 45 of the levers 41, the latter are deflected from the flowline and turned in an anti-clockwise direction. This lifts the lever side plates 39 and raises the stack clear of the primary feed roller 4. It will be realised that the resulting loss of traction from the feed roller 4 does not effect progress of the banknote N1 when this stage is reached. Simultaneously with the above movement, as will be seen from FIG. 12, the depending lever 46 is moved in a clockwise direction by the passage of banknote N1.

Figure 13:
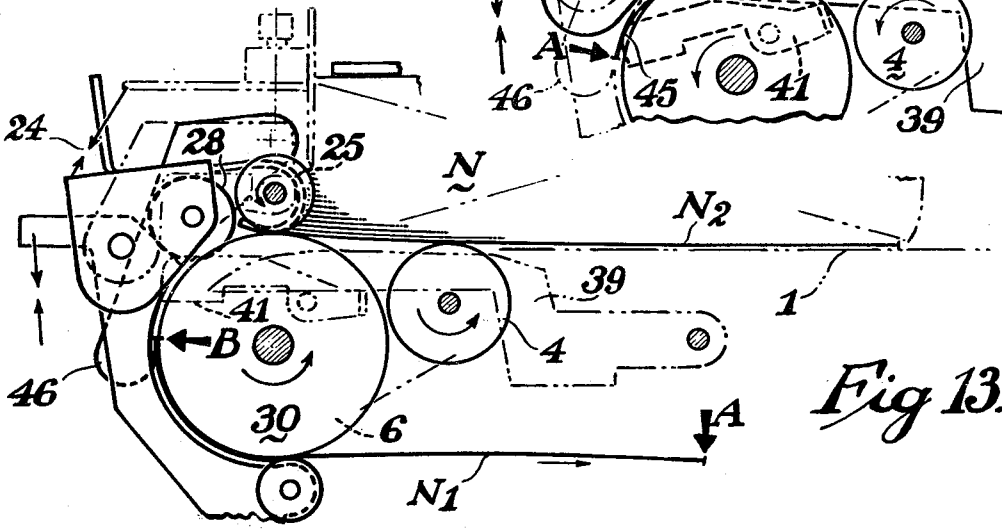

Finally, FIG. 13 shows the banknote N1 after it has progressed around 180° of the periphery of the rollers 6 and 30, and the trailing end (indicated by arrow B) has moved out of the previously mentioned "mesh-nips". In addition; it has freed and permitted the lever components 39 and 41 to return to their inoperative positions, but has prevented return of the depending lever 46 which is interlinked with the movement of the grooved roller 28 and the fork member 25. The effect of this is that the primary feed roller 4 again bears upon the following banknote N2 in the stack, but effective feeding through the various "mesh-nips" is prevented because the trailing end B of note N1 is still in contact with lever 46. However, when B passes beyond the lever 46, the spring 24 restores the effective engagement of the fork member 25 and note N2 is fed along the flowline in a manner similar to that described above.

In the description relating to FIGS. 1 and 2 it was emphasised that no direct nip is created between the reverse-rotation rollers 14 on the shaft 13 and the forward feeding rollers 30 and 6 on shaft 7 because of their non-coincidental position transversely across the apparatus. Accordingly, it will be realised that the intended function of the rollers 14 (viz, to hold back superposed banknotes), is principally dependent upon the lateral pitch between the shafts 13 and 7. From the above description it will also be recalled that a variation of lateral pitch may be effected by means of the adjustment screw 16 which serves to displace the axis of the shaft 13 with respect to the fixed axis of the shaft 7. The correct position of the shaft 13 is primarily determined by the physical characteristics of the paper and condition of the banknotes, because as will be appreciated, the stiffness of a banknote and hence its resistance to transverse corrugation, limits the effectiveness of the reverse-rotation friction rollers 14 to holdback superposed banknotes. Accordingly, when handling banknotes made from relatively thin paper, or possessing a soft or weak structural characteristic, it is necessary to decrease the lateral pitch as compared with comparatively stiff or thick banknotes, by means of the adjustment screw 16.

Figure 14:
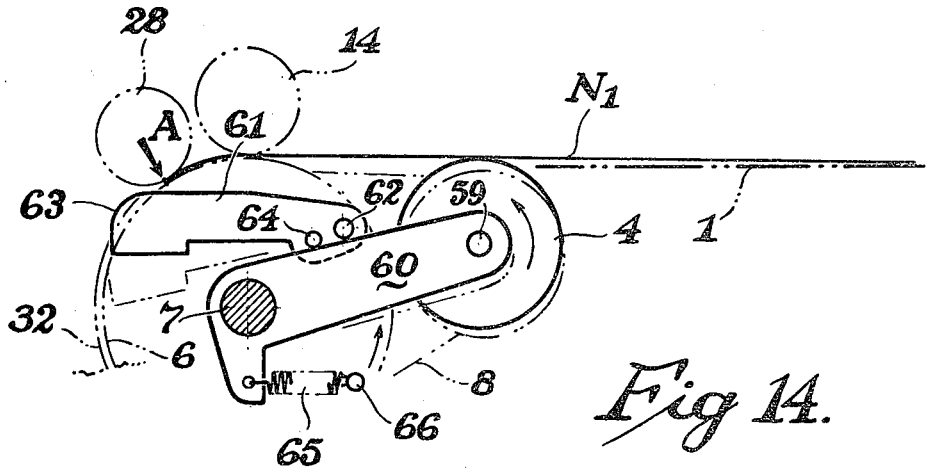
FIGS. 14 and 15 are side elevations of an embodiment of the invention showing a mechanism serving the same purpose as the mechanism shown in FIGS. 7 and 8, in two different operative positions.
Figure 15:
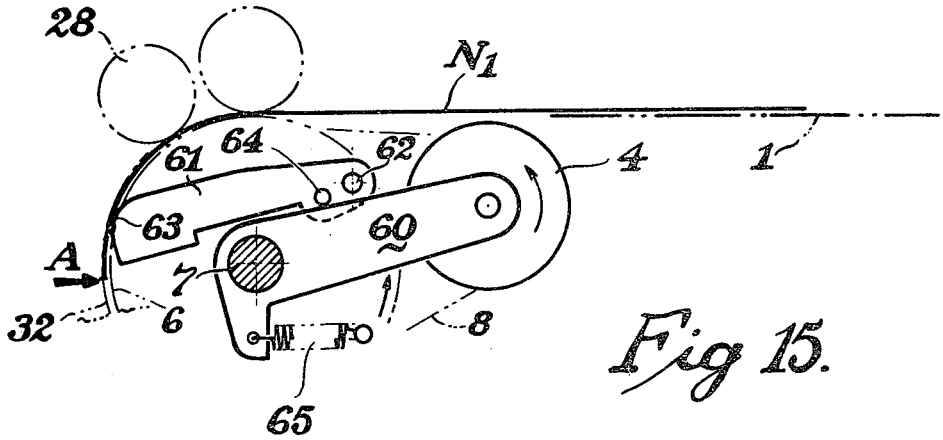

A brief reference will not be made to FIGS. 14 and 15 which illustrate an alternative mechanism for effecting relative separation between the underside of the stack N and the primary friction feed roller 4. The distinction of the mechanism shown in FIGS. 14 and 15 resides in the fact that the primary feed roller 4 is mounted on a movable shaft 59, the axis of which is adapted to move relatively to underside of the stack. The shaft 59 is journalled in the ends of a lever assembly 60 which is freely mounted astride the secondary feed roller 6, upon the driven shaft 7. The primary feed roller 4 is belt driven in the manner described above and it will be appreciated that the movement of the axis centre of the primary feed roller 4 is arcuate and consequently there is no variation of belt length. A pair of independent pivotal levers 61 are mounted upon aligned fixed axes 62 and the rounded extremities 63 thereof are arranged to protrude into the flowline defined between the guide surface 32 and the secondary feed roller 6, in the manner of the levers 41 of the first described example. A peg 64 is provided in the side of each of the levers 61 so as to contact the upper edges of the lever assembly 60 in the manner shown to establish a mechanical inter-connection therebetween. The lever assembly 60 is biased in an anti-clockwise direction by means of a pair of tension springs 65, the other ends of which are anchored to fixed pins 66.

The normal operative position of the mechanism is shown in FIG. 14 from which it will be seen that the primary feed roller is disposed above the support surface 1 and is engaging and propelling banknote N1 in a leftward direction. When the leading end A of the banknote N1 reaches the rounded ends 63 of the levers 61, the latter are deflected to the position shown in FIG. 15 and the pegs 64 rotate the lever assembly 60 in a clockwise direction against the action of the springs 65. The primary feed roller 4 is thereby retracted and disengaged from the stack, but the banknote N1 is propelled by the positive traction nip between the roller 28 and the secondary feed roller 6, in the manner described above. When the trailing end of N1 passes beyond the rounded ends 63 the mechanism will revert to the position shown in FIG. 14 by means of the springs 65. It will be appreciated that in the alternative arrangement the effort required from the moving banknotes to actuate the levers 60 and 61 merely serves to overcome the tension of the springs 65, and is thus, substantially constant regardless of the size or weight of the stack. Start/stop control may be effected by means of a solenoid (not shown) adapted to rotate the lever assembly 60 in a clockwise direction against the action of the springs 65.

In a still further embodiment of the invention, the mechanism for effecting relative separation between the underside of the stack and the primary feed roller 4 may comprise a simple lever system instead of the compound lever systems described above. This embodiment is not illustrated, but comprises a pair of freely mounted simple levers (one on each side of the secondary feed roller 6), adapted to protrude into the flowline at one end and to contact the underside of the stack, astride the primary feed roller 4, at the other end. The levers are pivotally mounted upon aligned axes, so positioned to provide a suitable mechanical advantage to lift the stack clear of the primary feed roller 4, upon the passage of a banknote.

A further embodiment of the invention will now be described with reference to FIGS. 16–18.

The main distinction between this embodiment and the examples described above resides in the fact that a belt of frictional material, indicated by symbol 70, is provided to engage the underside of the stack. This belt fulfils the function of the primary and secondary feed rollers of the previous embodiments and additionally serves to render unnecessary the inter-connecting drive belt 8. Primary and secondary rollers, shown by symbols 71 and 72, respectively, are still retained however, but these merely serve to carry the belt 70 and are of a reduced diameter to align the working surface of the belt with the two outwardly disposed rollers 30.

The primary feed roller 71 is adapted to rise and fall, by the oscillatory means described below, thereby to cause the frictional surface of the belt 70 to engage the underside of the stack in a manner similar to that of the roller 4 as shown in FIGS. 14 and 15. A further distinction of the present embodiment resides in the method of creating the requisite intermittent separation between the feeding means and the underside of the stack. In the previously described examples, to interrupt feed the stack is either lifted from the feeding means, or the feeding means is retracted from the stack, by a mechanical lever system which in turn is actuated solely by the passage of banknotes fed along the flowline. The power necessary to operate the said lever system is generally proportional to the weight of the stack and as the power attainable from a banknote is limited, the size and weight of a stack is also limited. In the embodiment described below, a powered servo means is provided to effect the separation and, via the intermediary of a mechanical lever and latching system, it is only necessary to extract a minimal amount of power from a banknote fed along the flowline. Accordingly, it is possible to feed from stacks of almost unlimited size, or from stacks biased with relatively high spring pressures, in a reliable manner.

Figure 16:
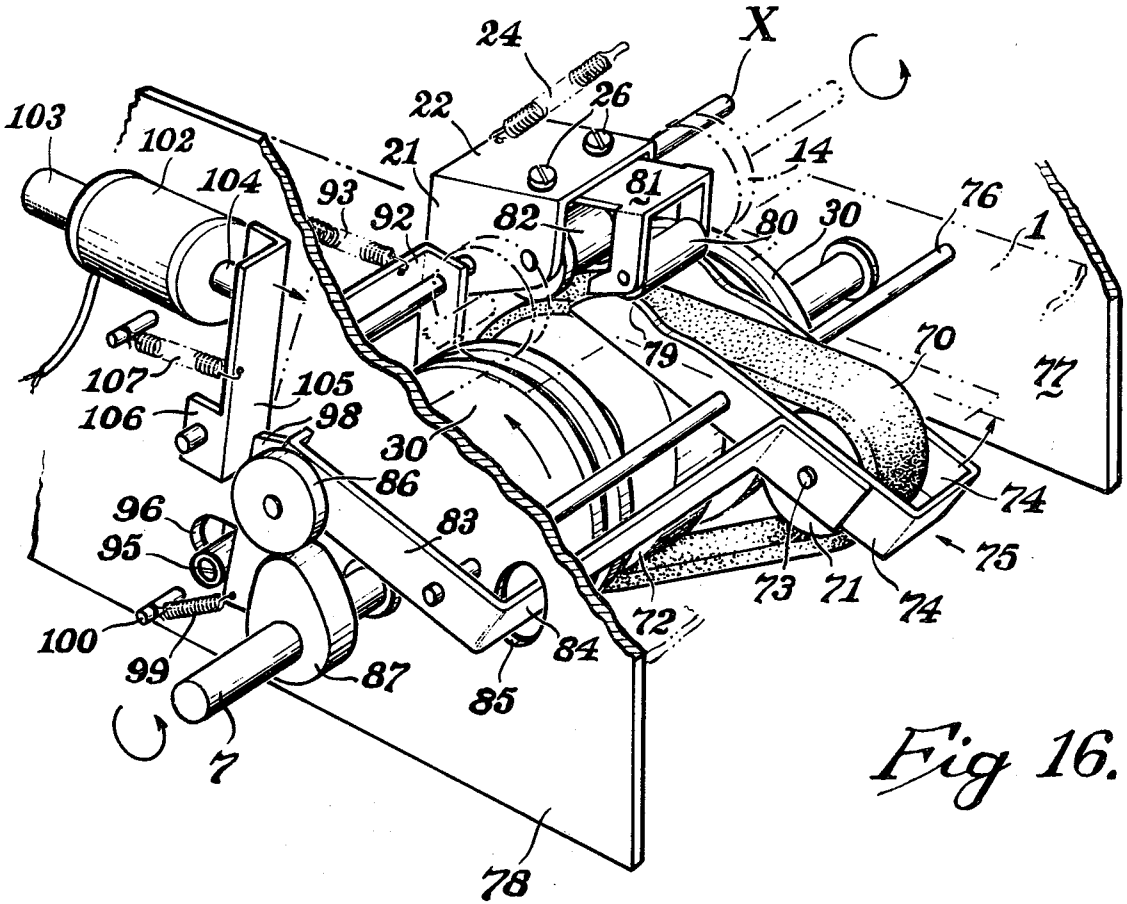
FIGS. 16 to 18 are perspective views of a further embodiment of the invention.
Figure 17:
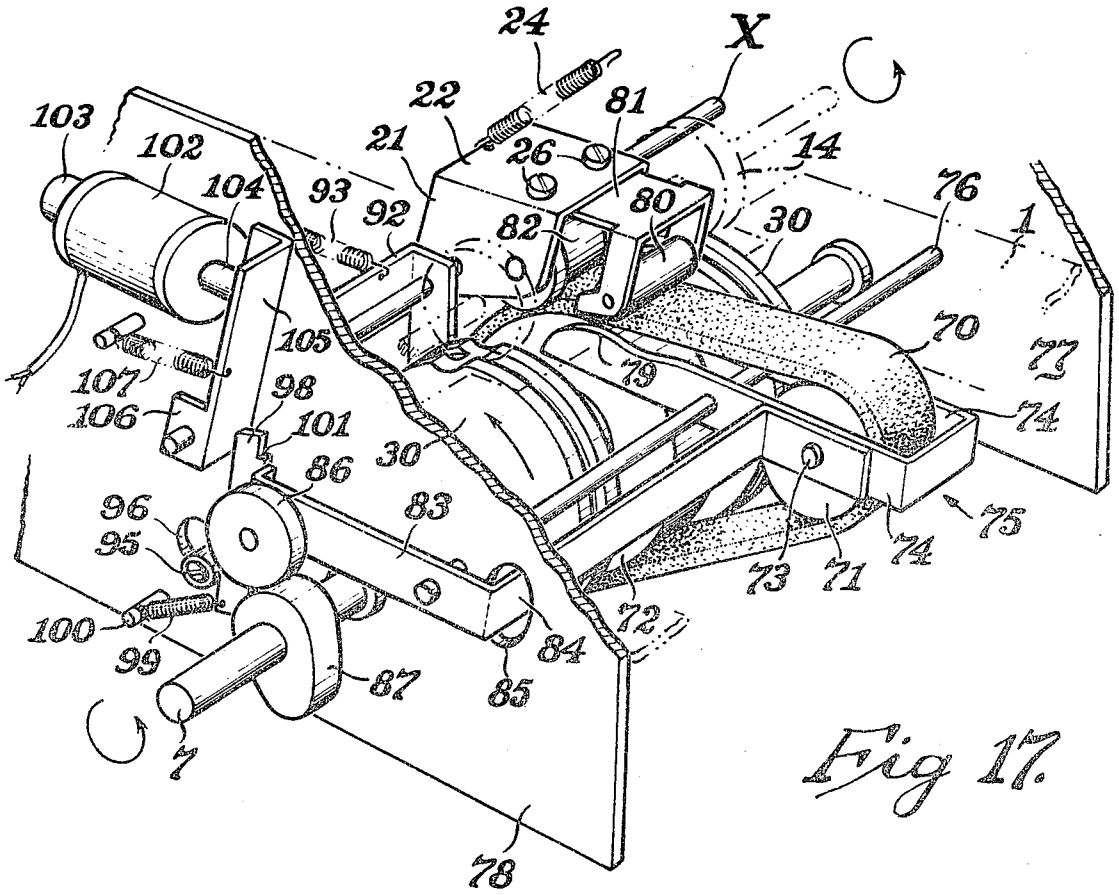
Figure 18:
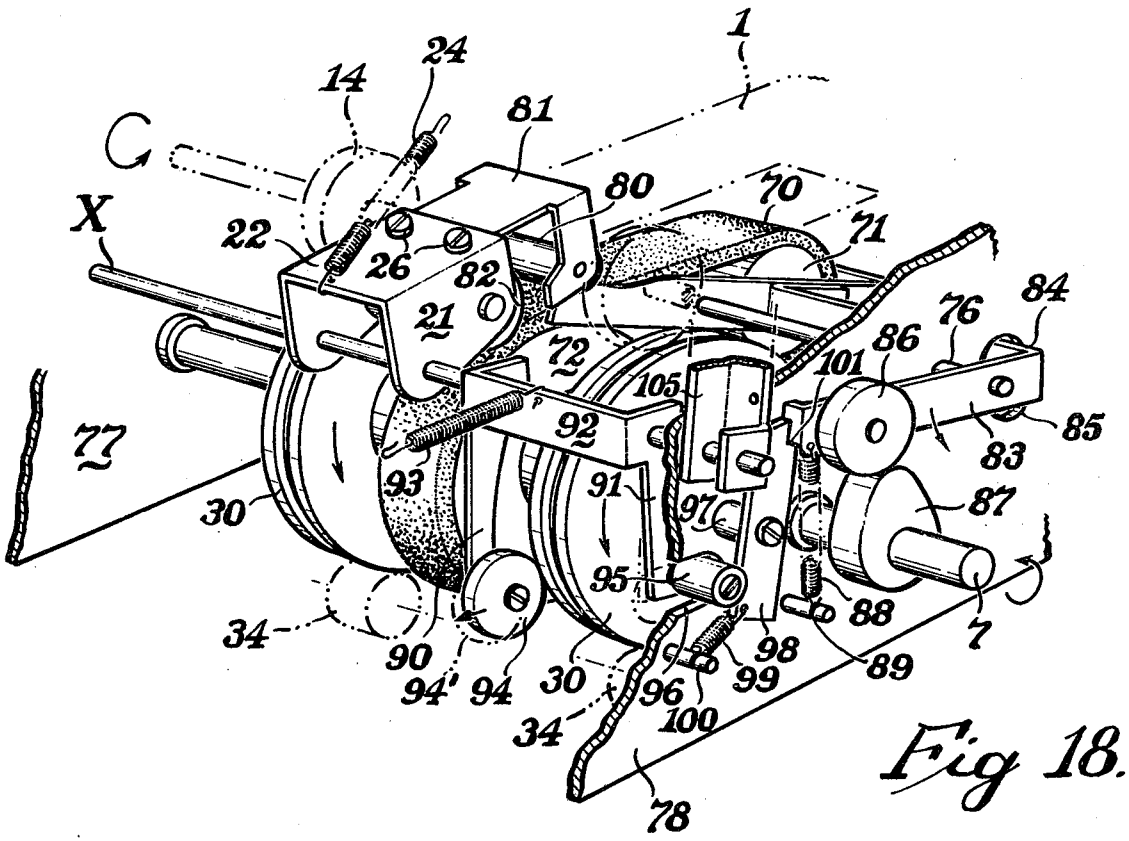

It should be noted that for reasons of simplicity certain components common to those described in the previously described embodiments have been partially or completely omitted from FIGS. 16–18. For example, the mounting means disposed upon shaft X for the reverse-direction rollers shown in FIG. 3 and the drive means therefor have been omitted, but the rollers themselves, viz symbol 14, have been shown in chain-dotted outline. In this embodiment the rollers 14 are sited axially to align with the annular grooves of the respective rollers 30. Similarly, the banknote guiding means shown in FIG. 6 has also been omitted but the guide rollers, item 34, are included in FIG. 18 as a chain-dotted outline.

The actuating and mounting means for the roller 71 will now be described with particular reference to FIGS. 16 and 17. The roller 71 is freely mounted upon a shaft 73, the opposite ends of which are carried in the side limbs 74 of a "U" shaped lever 75. The lever is pivotally mounted upon a transverse shaft 76 which extends through the main frames 77 and 78 of the apparatus. The free ends of the side limbs 74 are provided with rounded upper extremities 79 to engage with the lower periphery of a roller 80 freely mounted between the sides of a bifurcated bracket member 81 which is secured to the lever assembly 21,22 by screws 26. This latter lever assembly, which is included in the previous embodiments and serves a similar purpose, is biased in a clockwise direction about the shaft X by means of the tension spring 24. In the present embodiment, however, the roller 80 replaces the forked member 25 and a freely-running single-grooved pressure roller 82 replaces the multi-grooved pressure roller 28.

In FIGS. 16 and 18 the "U" lever is shown at its clockwise limit of rotation, in which position the belt 70 is disposed below the stack support surface 1 and the roller 80 is lifted clear of the belt by the extremities 79. In FIG. 17 the "U" lever is shown in its maximum anti-clockwise position wherein the belt is raised above the support 1 to engage the stack, and the extremities 79 are retracted thereby to permit the roller 80 to engage the belt 70.

The lever 75 is oscillated between the two above two positions by means of an actuating lever 83 which is freely mounted upon the shaft 76 and connected to the sideface of the limb 74 by means of a transverse connection strip 84 which passes through a clearance aperture 85 in the main frame 78.

Movement is imparted to the actuating lever 83 by means of a roller cam follower 86 freely mounted thereon and adapted to contact the profile of a cam 87 fixedly mounted to the drive shaft 7. The actuating lever 83 is biased in an anti-clockwise direction by means of a tension spring 88, the free end of which is anchored to the frame 78 by means of a pin 89. It will thus be seen that the power derived from the drive shaft 7 retracts the friction belt 70 against the effect of the spring and that the force of the spring lifts the belt to engage the stack.

The mechanical lever and latching system for controlling the movement of the actuating lever 83, upon the passage of banknotes fed along the flowline, will now be described with additional reference to FIG. 18.

Freely mounted upon the shaft X, between the lever assembly 21,22 and the main frame 78, is provided a pair of depending levers 90 and 91, which are connected together by a transverse bridging strip 92. The free end of a tension spring 93 (the opposite end of which is attached to the framework by means not shown) is attached to the upper extremity of bridging strip 92 thereby to bias the levers in an anti-clockwise direction. At the lower extremity of the lever 90 there is provided a freely running sensing roller 94 and at the lower extremity of the lever 91 there is provided a roller 95. The latter roller projects through the main frame 78 via an elongated clearance aperture, indicated by symbol 96. Symbol 97 indicates a stub shaft fixedly attached to the frame 78 which provides a pivot for a latching lever 98. The lever 98 is lightly biased in a clockwise direction by a tension spring 99 anchored to the frame 78 by a pin 100, and is provided with a notch 101 at its upper right-hand corner to engage the flanged extremity of the actuating lever 83. The lower lefthand edge of the latching lever 98 is adapted to contact the roller 95, associated with the depending lever 91 at certain times during operation of the apparatus.

The sensing roller 94 is arranged to overlap, and hence obstruct, the flowline of banknotes passing around the peripheries of the rollers 30 and the belt 70, but upon the passage of a banknote, to move from the flowline to a position as indicated by the chain-dotted outline 94'.

The working control means for the apparatus will now be described with particular reference to FIGS. 16 and 17 which show the mechanism in inoperative and operative conditions, respectively. A solenoid 102 (entirely omitted from FIG. 18) fixedly mounted to the frame 78 of the apparatus, is provided with a slidable armature 103, and an integral actuating plunger 104 adapted to contact and rotate a control lever 105. The lever 105 is principally of angle section and is provided with a short integral flange 106 at its lower side, as shown. This flange and the opposite face of the angle are drilled to permit the lever to pivot freely about the shaft X. A biassing spring 107 is provided to rotate the lever 105 in an anti-clockwise direction upon de-energisation of the solenoid. The lower extremity of the lever 105 is adapted to contact the upper lefthand side edge of the latching lever 98, thereby to prevent movement of the latter and hence latch the feed belt actuating lever 83 in a locked clockwise position, when the solenoid is de-energised (see FIGS. 16 and 18). It should be noted that the effective turning moments of the tension springs 93 and 99 are such that the roller 95 is capable of overcoming the opposite biassing force exerted by the latching lever 98. Furthermore, it should be noted that the tension of the spring 88 is relatively high thereby to ensure that the feed belt is co-acted against the stack to effect feeding, and also to create sliding friction between the end of the actuating lever 83 and the notch 101 of the latching lever thereby to ensure that the lever and the notch remain in engagement except when, in accordance with the operation of other machine components, disengagement is required.

OPERATION OF THE EMBODIMENT DESCRIBED IN FIGS. 16–18

Commencing from a "REST" position as shown in FIGS. 16 and 18, a stack of banknotes is placed upon the stack support surface 1 and upon starting the apparatus the driving motor rotates the driving shaft 7 together with the associated cam 87, rollers 30,72 and, via the belt 70, roller 71. The control lever 105 bears against the side of the latching lever 98 and effectively prevents the latter from releasing the arm 83 from the position shown inspite of the fact that the cam is rotating. Accordingly, no feeding takes place because the belt 70 is disposed clear of the underside of the stack.

Upon completion of a "START" circuit, energisation of the solenoid 102 expels the plunger 104 and thereby rotates the control lever 105 to the position shown in FIG. 17. This serves to free the latching lever 98 and when the cam 87 rotates to a top-centre position it lightly contacts the cam follower 86 and lifts the arm 83 sufficiently to free the latching lever 98 which is rotated in an anti-clockwise direction by means of the roller 95 which is in turn biased by the tension spring 93. Thereafter, the sensing roller 94 obstructs the flowline and the cam follower 86 follows the profile of the cam 87 thereby to raise the belt 70 above the stack support surface 1, and also to lower the freely running roller 80 onto the surface of the belt. The effect of this is to remove the lowermost banknote from the stack and propel it to the feeding nip and thence into the nip formed between the grooved roller 82 and the belt. As explained above, the effective peripheries of the roller 82 and the belt overlap and accordingly the passage of a banknote therebetween lifts the roller 82 and pivots the lever assembly 21,22,81 about shaft X, thereby lifting the freely running roller 80 clear of the belt. This breaks the feeding nip and enables the reverse-direction rollers 14, to holdback superposed banknotes fed forward with the lowermost banknote. In addition, the roller 82 provides positive traction for the banknote and it is thereafter propelled along a flowline formed between the peripheries of the rollers 30 and the associated guiding etc means shown in FIG. 6. During this passage the leading edge of the banknote contacts the sensing roller 94 and moves it from the flowline. This serves to turn the levers 90,91 in a clockwise direction which moves the roller 95 away from the side of the latching lever 98.

Upon movement of the roller 95 the tension spring 99 rotates the latching lever 98 in a clockwise direction into its operative position and when the arm 87 lifts the roller follower 86 to its upper limit of movement, the extremity of the actuating arm 83 latches into the notch 101, thereby to retain the belt 70 in its retracted inoperative position with respect to the stack.

Further rotation of the driving shaft 7 propels the banknote along the flowline and when the trailing end of the banknote passes upstream beyond the sensing roller 94 the latter returns across the flowline by action of the tension spring 93. The roller 95 then bears upon the lower end of the latching lever 98 but, because of the friction between the end of the arm 83 and the notch 101, does not free the actuating lever until the cam 87 again reaches top centre after which the above described procedure is repeated to feed a further banknote provided that the control solenoid 102 remains energised.

It will therefore be appreciated that the above described mechanical lever system effectively creates predetermined gaps between successive banknotes fed along the flowline through a sequential process of latching and unlatching, and in addition, by the use of a servo means to effect the intermittent separation the banknote is not subjected to arduous duty.

It should further be appreciated that during the feeding cycle of a banknote the actuating lever 83 is not latched and unlatched every revolution of the drive shaft 7. This wholly depends upon the diameter of the roller system and the longitudinal length of a banknote. In the above described example, a banknote of average length is fed every alternate revolution, but upon feeding abnormally long banknotes, feeding may take place only once every third revolution.

A further advantage will be seen in the last described embodiment in so far that intermittent impacting of the belt against the underside of the stack effectively separates adjacent banknotes. In the case of severely adhered together banknotes the apparatus will continue to reciprocate until eventual separation takes place.

I claim:

1. Apparatus for removing sheets one at a time from a face of a stack of sheets and feeding the sheets so removed sequentially along a flow-line, said apparatus comprising an endless friction feed belt for engaging the face and moving a sheet from a stack in a direction substantially parallel to the face and into said flow-line, first pulley means mounting said belt in the vicinity of the face, second pulley means mounting the belt remotely from the face, sheet seizing means for receiving and conveying further along said flow-line a sheet removed from the stack, said sheet seizing means including a nip formed between a roller and said belt in the vicinity of said second pulley means, a lever system including a first component biased to obstruct the flow-line downstream of said sheet seizing means but movable from said flow-line by the passage of a sheet along said flow-line and a second component for moving said belt out of engagement with the face, spring means for biasing said belt into engagement with the face, means connected to said second pulley means for driving the same, cam means fast with said driving means, cam-follower means coacting with said cam means and connected to said second component, and mechanical linkage for transmitting movement of said first component to control the movement of said second component, said mechanical linkage means including:

(i) pivotal lever means integral with said first component and arranged to actuate (ii) second pivotal lever means including a first latching component arranged for latching engagement with (iii) second latching means integral with said second component, whereby with the drive means working continuously said feed belt oscillates between a position in which it engages the face and a position in which it is out of engagement with the face until movement of said first component clear of the flow-line causes said feed belt, through said mechanical linkage means and through latching of said first and second latching means, to remain out of engagement with the face until said first component is no longer prevented from obstructing said flow-line and until coaction between said cam and cam-follower unlatches the first and second latching means thereby to permit said spring means to re-engage the belt with the face.

2. Apparatus for removing sheets one at a time from a face of a stack of sheets and feeding the sheets so removed sequentially along a flow-line, said apparatus comprising an endless friction feed belt for engaging the face and moving a sheet from a stack in a direction substantially parallel to the face and into said flow-line, first pulley means mounting said belt in the vicinity of the face, second pulley means mounting the belt remotely from the face, sheet seizing means for receiving and conveying further along said flow-line a sheet removed from the stack, said sheet seizing means including a nip formed between a roller and said belt in the vicinity of said second pulley means, a lever system including a first component biased to obstruct the flow-line downstream of said sheet seizing means but movable from said flow-line by the passage of a sheet along said flow-line and a second component for moving said belt out of engagement with the face, and mechanical linkage means for transmitting movement of said first component to control the movement of said second component, said mechanical linkage means including pivotal lever means integral with said first component.

3. Apparatus for removing sheets one at a time from a face of a stack of sheets and feeding the sheets so removed sequentially along a flow-line, said apparatus comprising first feed means for engaging the face and moving a sheet from a stack in a direction substantially parallel to the face and into said flow-line, sheet seizing means downstream of said first feed means along said flow-line for receiving and conveying further along said flow-line a sheet removed from the stack, said sheet seizing means including a nip formed between a second feed means and a roller disposed on opposite sides of said flow-line, lever means operative by a sheet moving downstream of said nip for creating relative separation between said face and said first feed means, said lever means including first and second levers mounted for pivotal movement at respective fixed first and second pivot means, said first lever having a first portion disposed downstream of said nip and normally located to obstruct the flow-line but being movable from said flow-line by the passage of a sheet along said flow-line, said second lever having a first portion remote from said second pivot means for effecting said relative separation between said face and said first feed means, and said first lever having a second portion remote from said first lever first portion for directly contacting and pivoting said second lever in the absence of further movable linkage means about said second fixed pivot means in direct mechanical response to the movement of said first lever first portion by a sheet moving downstream of said nip whereby pivotal movement of said first lever at said first pivot means imparts pivotal movement of said second lever at said second pivot means and movement of said second lever first end portion effects said face and first feed means separation.

4. The apparatus as defined in claim 3 wherein said first feed means is carried by said first end portion of said second lever.

5. The apparatus as defined in claim 3 wherein said first feed means is carried by said first end portion of said second lever, and the point of contact between said first and second lever is generally between said first lever first portion and first pivot means and said second lever first portion and second pivot means.

6. The apparatus as defined in claim 3 wherein said second lever first portion is a free end portion and the point of contact between said first and second levers is between said first lever second portion and said free end portion of said second lever.

7. The apparatus as defined in claim 6 wherein said first pivot means is disposed medially of said first lever first and second portions, and said second pivot means is at a second end portion of said second lever.

8. The apparatus as defined in claim 4 including means normally biasing said second lever in a direction to move said first feed means toward said face.

9. The apparatus as defined in claim 8 wherein said biasing means is operative through a second end portion of said second lever.

* * * * *